US005148999A

United States Patent [19]

Curfman et al.

[11] Patent Number: 5,148,999

[45] Date of Patent: Sep. 22, 1992

[54] ANIMAL FEED MIXING SYSTEM

[75] Inventors: Robert M. Curfman; J. Phil Roach, both of Sunnyside, Wash.

[73] Assignee: Farm Shop, Inc., Sunnyside, Wash.

[21] Appl. No.: 640,213

[22] Filed: Jan. 11, 1991

[51] Int. Cl.[5] ..... B02C 19/22

[52] U.S. Cl. ..... 241/260.1; 241/291; 366/603

[58] Field of Search ..... 366/603; 241/101.7, 241/260.1, 294, 292.1, 291

[56] References Cited

U.S. PATENT DOCUMENTS 3,294,133 12/1966 Clans ..... 241/260.1 X
3,968,998 7/1976 Wolf ..... 241/260.1 X
4,951,883 8/1990 Loppoli et al. ..... 241/260.1 X

FOREIGN PATENT DOCUMENTS 1470324 4/1989 U.S.S.R. ..... 241/260.1

*Primary Examiner*—Mark Rosenbaum
*Assistant Examiner*—C. Richard Martin
*Attorney, Agent, or Firm*—Christensen, O'Connor, Johnson & Kindness

[57] ABSTRACT

An animal feed mixer includes an auger of unique design. Inserts having cutting edges are positioned at spaced locations in notches provided therefor in the peripheral edge of the auger flight. The inserts co-act with the sides of the mixer to cut and chop fibrous material so that is can be better intermixed with other feed components.

10 Claims, 3 Drawing Sheets

ANIMAL FEED MIXING SYSTEM

FIELD OF THE INVENTION

The present invention relates to an animal feed mixing system, and more particularly to a specialized auger used in a portable mixing system.

BACKGROUND OF THE INVENTION

Animal feed mixers can be mounted on trucks or specially designed trailers. The mixer is a specially designed bin that contains a plurality of augers. Several components of animal feed are unloaded into the bin and the augers are rotated to move the feed around within the bin, intermixing it in the process. The augers are designed so that the feed is ultimately moved to one location in the bin where it can be unloaded through an opening in a side of the bin at a desired destination by continuing rotation of the augers.

The components of animal feed mixed in the mixers vary widely in composition and texture. Some of the more troublesome components are hay, cornstalks or other elongated fibrous material. This fibrous material tends to compact between the auger and the sides of the bins, at times clogging the mixing system as well as not being efficiently intermixed with the remaining feed components.

A variety of approaches has been taken to correct the problem associated with attempting to intermix elongated fibrous materials; however, none have been completely successful in solving the problem. One suggestion is to form a blunt notch in the periphery of the flight of the auger to move the fibrous material along the auger. Although the notch is an improvement, the notch wears, changes shape and becomes ineffective after relatively short periods of use. Another suggestion has been to attach cutting blades at spaced locations along the peripheral edge of the auger flight. While this solution partly solves the problem, the cutting blades tend to de-attach from the auger periphery and also are readily damaged and broken. Yet a third suggestion has been to place a small cutting blade along the leading edge of a notch in an auger flight. This solution, too, has not been completely satisfactory because of incomplete cutting action and because the portion of the periphery of the auger flight above the cutting edge tends to wear excessively.

SUMMARY OF THE INVENTION

The present invention solves the problems associated with mixing elongated fibrous material in animal feed mixing systems. The invention includes at least one and preferably a pair of specially designed augers positioned in the bottom of an animal feed mixer employing two or more such augers. At least one of the augers situated in the bottom of the feed mixing container has a flight joined to a central shaft. The flight has at least one notch in the periphery thereof that has an inwardly oriented side and a bottom side. The bottom side of the notch extends from the inwardly oriented side preferably in a smooth arc in the direction of rotation of the auger to join the peripheral edge of the auger. A cutting insert is positioned in the notch. The insert has a first cutting edge that extends inwardly and in the direction of rotation from a location outwardly from the edge of the flight toward the bottom of the notch. Preferably a second cutting edge oriented substantially tangentially to the peripheral edge of the flight and positioned outwardly from the edge of the flight is also included in the insert. The second cutting edge intersects the upper portion of the first cutting edge at an angle.

BRIEF DESCRIPTION OF THE DRAWINGS

A better understanding of the present invention can be derived by reading the ensuing specification in conjunction with the accompanying drawings wherein.

DETAILED DESCRIPTION OF THE PREFERRED EMBODIMENT

Figure 1:
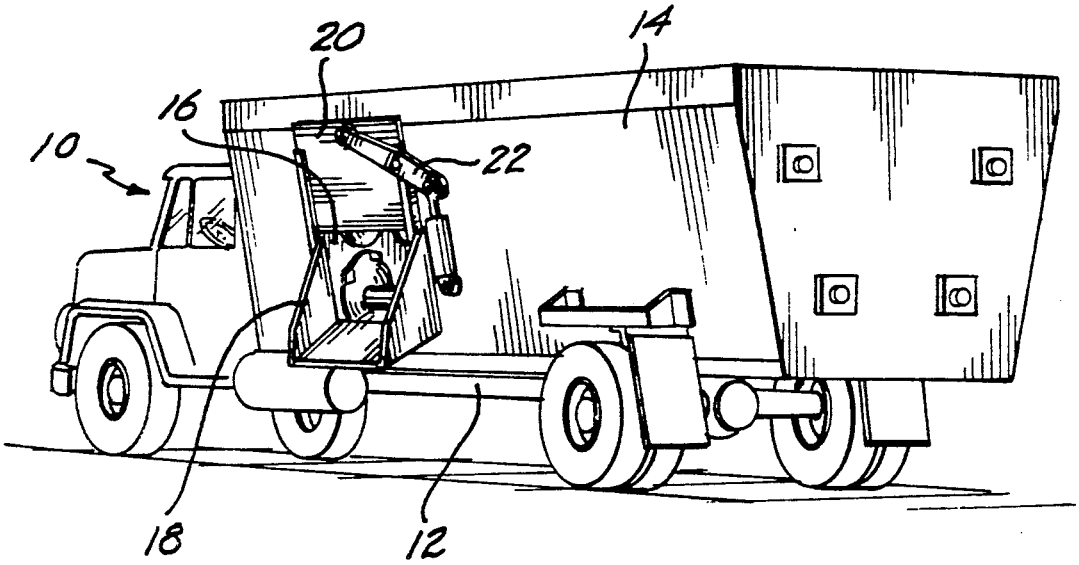
FIG. 1 is a perspective view of a feed mixing system employing the auger of the prsent invention.

Referring first to FIG. 1, a feed mixing system employing the special auger constructed in accordance with the present invention includes a truck generally designated 10 having a rearwardly extending bed 12. The mixing bin 14 is positioned on the top of the truck bed 12. A bin unloading opening 16 is located on the forward, bottom portion of the bin 14. A chute 18 is positioned under the opening 16. A door 20 can be raised and lowered by conventional operating mechanism 22 to cover the opening 16.

Figure 2:
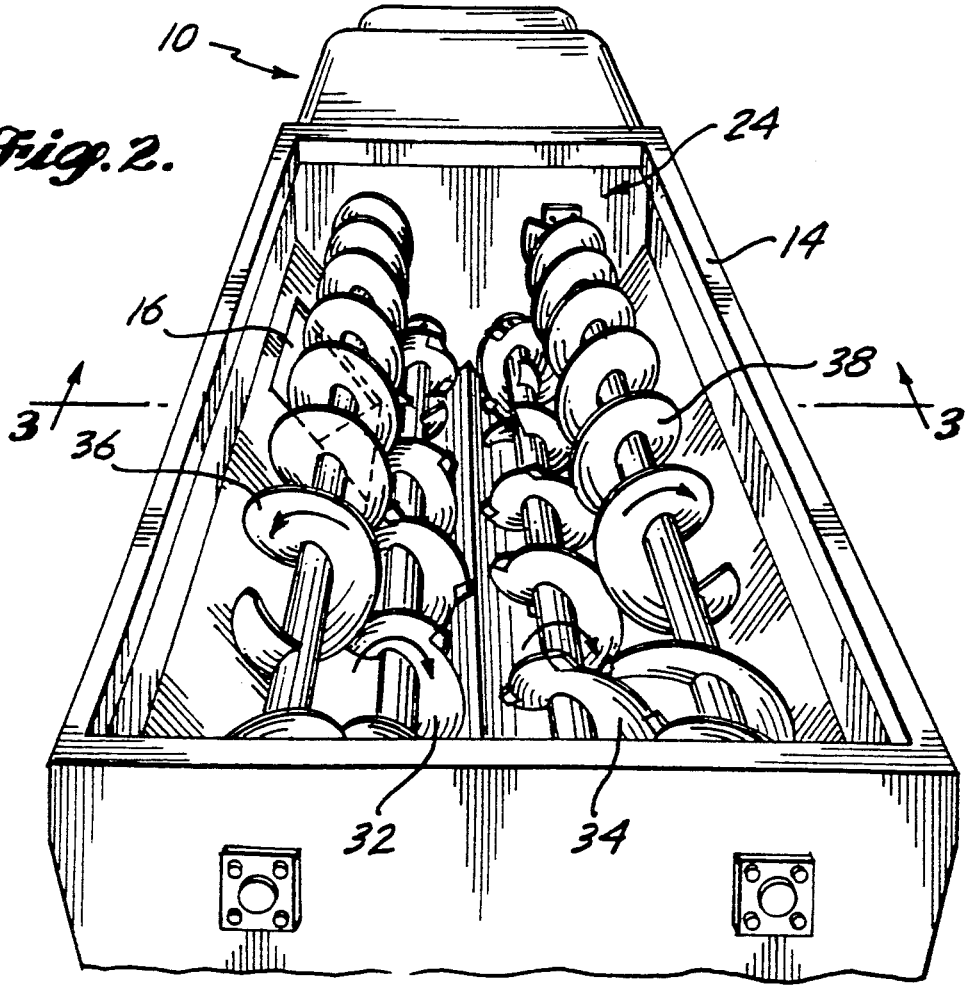
FIG. 2 is a perspective view of the feed mixer, looking from the top toward the bottom and front of the mixing container.
Figure 3:
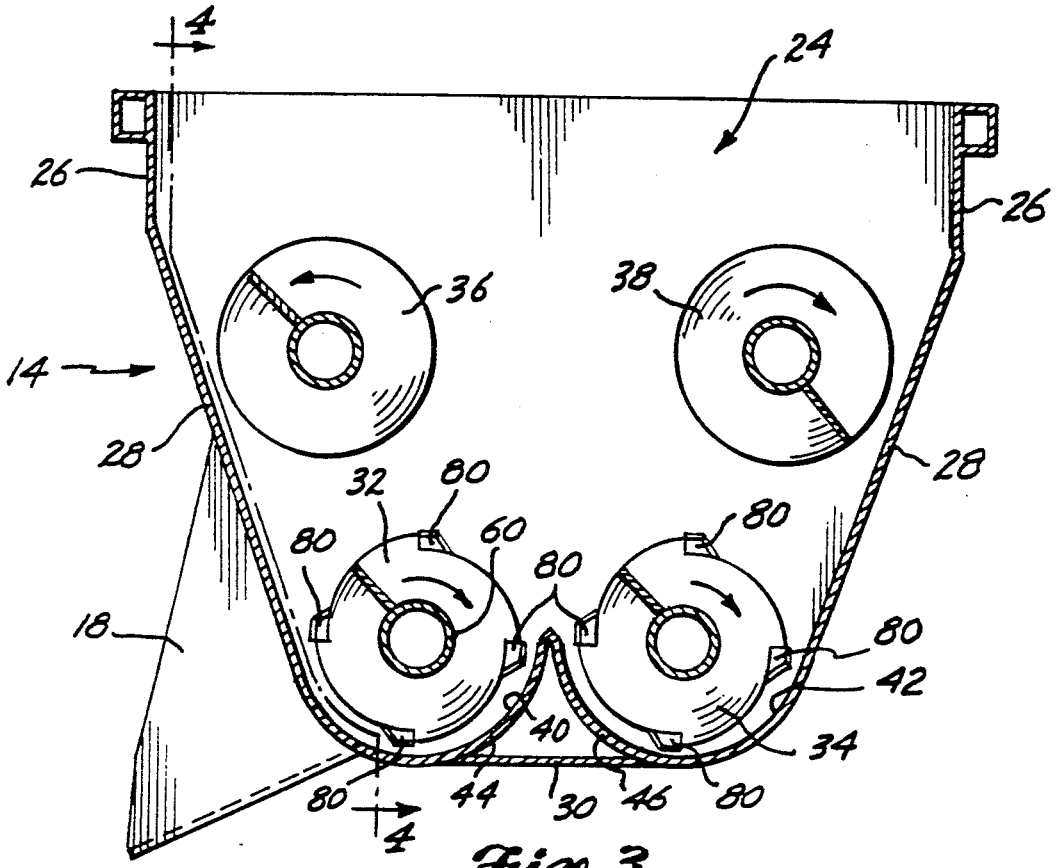
FIG. 3 is a cross-sectional view of the mixing container employing the augers of the present invention taken along section line 3—3 of FIG. 2.

Referring conjunctively to FIGS. 2 and 3, the container 14 has an open top 24 into which feed components are loaded. The upper portion of of the has vertical side walls 26 that blend into downwardly converging side walls 28. The bottom portions of the downwardly converging side walls 28 join the bottom 30 of the bin 14 in a smooth arc. A first pair of augers 32 and 34 is positioned in the bottom of the bin and extends longitudinally from the rear of the bin to the forward portion of the bin. A second pair of augers 36 and 38 is positioned in the upper portion of the bin upwardly and slightly outboard of the first pair of augers 32 and 34.

Figure 3A:
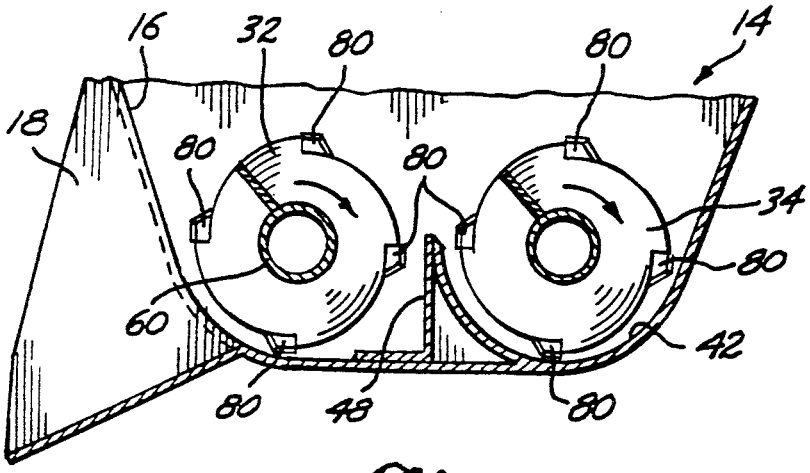
FIG. 3A is an alternate embodiment of the mixing container of the present invention.

In one embodiment, the lower augers 32 and 34 are situated in a pair of troughs 40 and 42. The outboard sides of the troughs are formed by the lower rounded corners of the lower portions of the converging side walls 28, while side wall extensions 44 and 46 extend inwardly and upwardly in spaced relationship between the augers 32 and 34 to a point where they are joined about midway up the augers. In an alternate embodiment, shown in FIG. 3A, the inside wall of the left trough has a vertical wall 48 instead of the curved side wall. The augers are all mounted for rotation in suitable journals in the rear and forward walls of the bin 14. A suitable conventional drive mechanism located in a false rear wall rotates the augers in the direction shown by the arrows in the drawings.

Both bottom augers 32 and 34 are uniquely configured in accordance with the present invention. Because both augers 32 and 34 are of similar construction, the invention will be described in conjunction with the left auger 32. Referring to FIGS. 3, 4, 5 and 6, the left auger 32 has a central shaft 60 that is rotatably mounted in a suitable journal 62 in the front wall 64 of the bin 14. The rear of the shaft 60 extends through a false rear wall 66 and is also rotatably mounted in the rear wall of the bin 14 (not shown in FIG. 4). The drive mechanism for the augers is mounted between the false wall 66 and the rear wall. The shaft 60 carries a rear flight 68 and a front flight 70 of reverse hand to flight 68. As auger 32 is rotated in a clockwise direction (viewing from the rear), material is moved forwardly toward the outlet 16 shown in ghost outline in FIG. 4. The flights 68 and 70 carry notches 72 at spaced locations around the flight. In the preferred embodiment, the notches are located approximately every 90°. The notches 72 have an inwardly oriented rear edge 74 facing in the direction of rotation. The notch 72 also has a bottom edge 76 that extends from the bottom of rear edge 74 in the direction of rotation toward and joining the peripheral edge 78 of the auger. Preferably, the notch extends forwardly in a generally smooth arc.

Figures 4, 5, 6, 7, 8, 9:
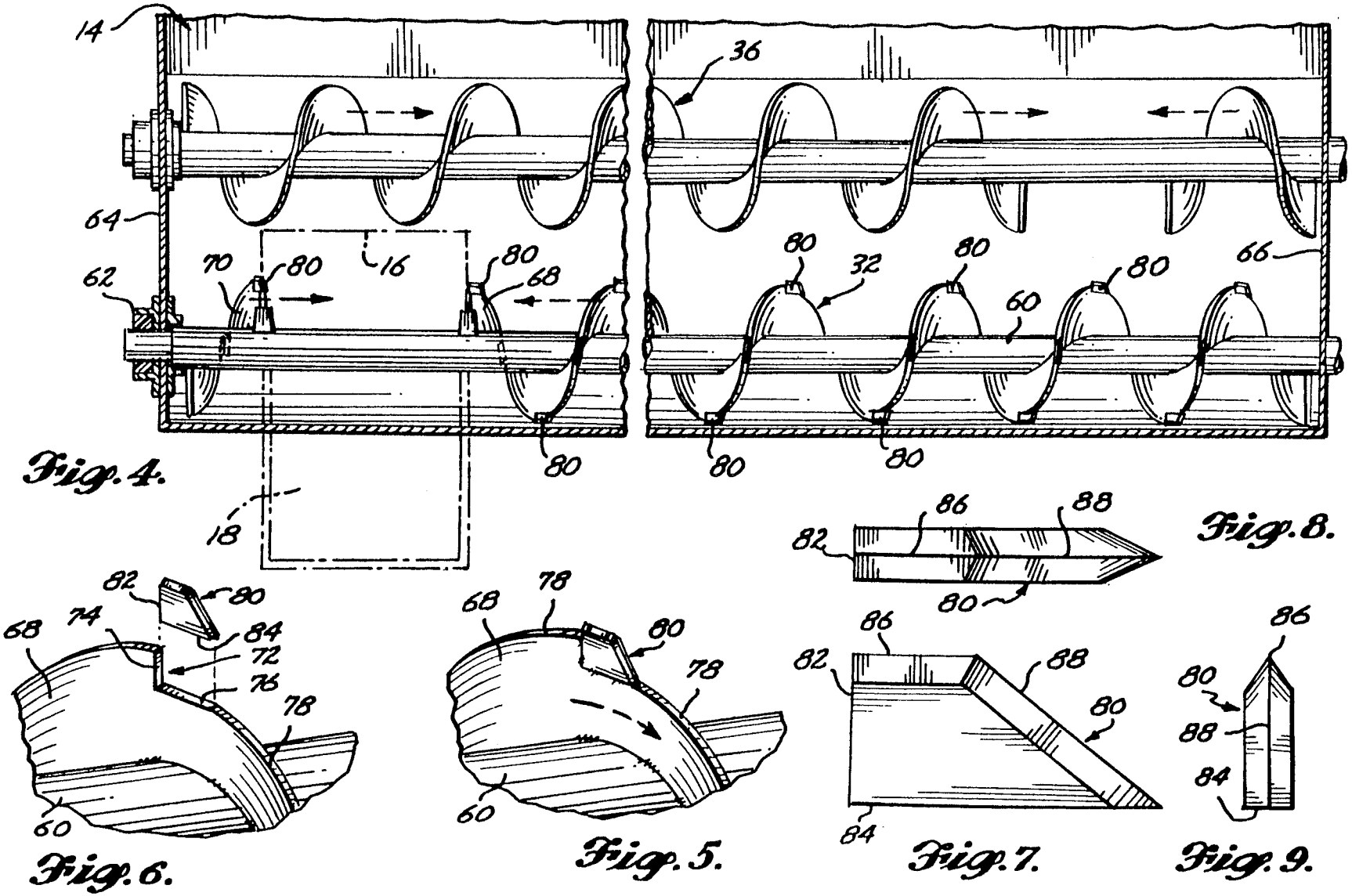
FIG. 4 is a longitudinal sectional view taken along a line similar to section line 4—4 of FIG. 3.
FIG. 5 is an enlarged perspective view of a cutting insert positioned on an auger.
FIG. 6 is a view similar to FIG. 5, showing the insert about to be positioned on the auger flight.
FIGS. 7, 8 and 9 are side elevation, top and forward end views of the insert.

A trapezoidal insert 80, also shown in FIGS. 7-9, has a rear edge 82 and a bottom edge 84 that abut the rear edge 74 and bottom edge 76 of the notch 72. The insert 80 is positioned in the notch 72 and secured in the notch by conventional means such as welding. The top and forward portions of the insert 80 are beveled to cutting edges 86 and 88. When the insert 80 is positioned in the notch 72, the outer cutting edge 86 is oriented generally tangentially relative to the auger. The upper edge 86 is also positioned slightly outwardly from the peripheral edge 78 of the flight 68. The forward cutting edge 88 faces in the direction of rotation of the auger and extends inwardly and in the direction of rotation from an intersection point with the outer edge 86 to the bottom edge 76 of the notch 72. The insert is preferably composed of knife grade steel, most preferably from high strength, chrome alloy steel.

Referring back to FIG. 3, in operation, the inserts 80 rotate with the auger flight 68 in close proximity to the inside surface of trough 40. As elongated fibrous material such as cornstalks, hay and the like lodge between the auger periphery and the trough 40, the forward edge 88 and the outer edge 86 in sequence cut through the larger materials and then slice smaller materials against the surface of the trough. In this manner, the long fibrous materials are segmented and intermixed with the other feed components. Moreover, the fibrous materials will not clog in the spaces between the peripheral edge of the auger and the bottom and sides of the bin.

The present invention has been described in relation to a preferred embodiment. One of ordinary skill, however, will be able to make various changes, alterations and substitutions of equivalents without departing from the broad concepts disclosed herein. It is therefore intended that the Letters Patent granted hereon be limited only by the definition contained in the appended claims and equivalents thereof.

The embodiments of the invention in which an exclusive property or privilege is claimed are defined as follows:

1. An auger comprising:

a central shaft;

a flight joined at its inner peripheral edge to said central shaft, said flight having at least one notch in its outer peripheral edge, said notch having an inwardly oriented rear side and an adjacent bottom side, said bottom side extending in the direction of rotation of said flight to join with said outer peripheral edge of said flight; and an insert positioned in said notch, said insert having a first mounting side positioned adjacent said rear side of said notch and a second mounting side positioned adjacent said bottom side of said notch, said insert further having a first cutting edge extending inwardly and in the direction of rotation of said flight from a location above said outer peripheral edge of said flight toward said bottom side of said notch.

2. The auger of claim 1 wherein said insert further comprises:

a second cutting edge oriented substantially tangentially to said outer peripheral edge of said flight and positioned outwardly from said outer peripheral edge of said flight, said second cutting edge joining the upper portion of said first cutting edge at an angle.

3. The auger of claim 2 wherein said insert is composed of a high strength chrome alloy steel.

4. The auger of claim 1 wherein said insert is composed of a high strength chrome alloy steel.

5. The auger of claim 1 wherein said insert has a rearward edge that is substantially parallel to and abutting said inwardly oriented rear side of said notch.

6. The auger of claim 5 wherein said insert has a bottom edge that is substantially parallel to and abutting said bottom side of said notch.

7. The auger of claim 6 wherein said insert is welded to said flight.

8. The auger of claim 1 wherein said bottom side of said notch extends toward and joins said outer peripheral edge of said flight in a smooth arc.

9. The auger of claim 8 wherein said inwardly oriented rear side of said notch is substantially radially oriented.

10. A feed mixer comprising:

a bin;

an auger including a central shaft mounted for rotating movement in said bin in close proximity to an inside surface thereof;

a flight joined at its inner peripheral edge to said central shaft, said flight having at least one notch in its outer peripheral edge, said notch having an inwardly oriented rear side and an adjacent bottom side, said bottom side extending in the direction of rotation of said flight to join with said outer peripheral edge of said flight; and an insert positioned in said notch, said insert having a first mounting side positioned adjacent said rear side of said notch and a second mounting side positioned adjacent said bottom side of said notch, said insert further having a first cutting edge extending inwardly and in the direction of rotation of said flight from a location above said outer peripheral edge of said flight to said bottom side of said notch, said insert further having a second cutting edge oriented substantially tangentially to said outer peripheral edge of said flight and positioned outwardly from said outer peripheral edge of said flight, said second cutting edge joining the upper portion of said first cutting edge at an angle.

* * * * *